US006976882B2

(12) United States Patent
Kernan

(10) Patent No.: US 6,976,882 B2
(45) Date of Patent: Dec. 20, 2005

(54) DETACHABLE POWER SUPPLY APPARATUS

(75) Inventor: Colin Michael Kernan, Hingham, MA (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/790,951

(22) Filed: Mar. 2, 2004

(65) Prior Publication Data

US 2005/0197015 A1 Sep. 8, 2005

(51) Int. Cl.[7] ..... H01R 25/00
(52) U.S. Cl. ..... 439/638; 219/432; 439/38
(58) Field of Search ..... 439/39, 638, 38; 219/429, 432, 435

(56) References Cited

U.S. PATENT DOCUMENTS

| | | | | |
|---|---|---|---|---|
| 3,363,214 | A | 1/1968 | Wright | 339/12 |
| 3,926,493 | A | 12/1975 | Wakabayashi | 339/12 R |
| 4,211,456 | A | 7/1980 | Sears | 339/12 R |
| 6,250,931 | B1 | 6/2001 | Mendelson | 439/39 |
| 6,267,602 | B1 | 7/2001 | Mendelson et al. | 439/39 |
| 6,478,614 | B1 | 11/2002 | De' Longhi | 439/519 |
| 6,527,570 | B1 | 3/2003 | Hartman et al. | 439/180 |
| 6,568,942 | B2 | 5/2003 | Lau et al. | 439/39 |
| 6,607,391 | B2 | 8/2003 | Mendelson et al. | 439/39 |
| 6,740,852 | B1 * | 5/2004 | Wu et al. | 219/436 |
| 2002/0016088 | A1 | 2/2002 | Mendelson et al. | 439/39 |
| 2002/0017517 | A1 | 2/2002 | Li | 219/494 |
| 2002/0086559 | A1 | 7/2002 | Dalmau Ferrerfabrega et al. | 439/39 |
| 2002/0152897 | A1 | 10/2002 | Bouly et al. | 99/337 |
| 2002/0160629 | A1 | 10/2002 | Lau et al. | 439/39 |
| 2003/0092299 | A1 | 5/2003 | Hartmann et al. | 439/180 |
| 2004/0077187 | A1 * | 4/2004 | Belongia et al. | 439/39 |

* cited by examiner

*Primary Examiner*—Michael C. Zarroli
(74) *Attorney, Agent, or Firm*—Lawrence Cruz; Steven A. Garner

(57) ABSTRACT

A detachable power supply apparatus for an appliance has a temperature control device for electrical connection to the appliance. The temperature control device has a first member extending outwardly therefrom and a conductor on the first side of the temperature control device. The temperature control device has a probe on a second side substantially opposite the first side. The apparatus has a power supply cord with a female electrical connector that connects to the conductor. The female connector is connectable to a power supply to supply power to the female connector and to the conductor. The power supply cord has a clip member that selectively fastens to the first member so that the first member disengages the clip member without disturbing a position of the appliance upon application of a force on the power supply cord.

22 Claims, 10 Drawing Sheets

DETACHABLE POWER SUPPLY APPARATUS

BACKGROUND OF THE INVENTION

1. Field of the Invention

The present invention relates to a detachable power supply apparatus. More particularly, the present invention relates to a power supply apparatus that is a breakaway power supply apparatus used with an electrical appliance to increase safety.

2. Description of the Related Art

Detachable power supply devices are known in the art. One such application of a detachable power supply device is used with a temperature probe for a consumer appliance. These temperature probes are used with cooking appliances such as popcorn makers, cookers, broilers, grillers, and deep fat fryers, that cook with oil and shortening.

The temperature probe requires a first connection to the cooking appliance, such as the deep fat fryer, and a second connection to a power supply. The temperature probe accurately maintains and controls an acceptable working temperature of the cooking appliance. The temperature probe is often detachable from the cooking appliance so the temperature probe can be removed from the cooking appliance when washing the cooking appliance. This prevents the temperature probe from getting wet and thus damaged during washing of the cooking appliance.

This first connection to the cooking appliance is usually through a female port on the cooking appliance. The temperature probe has a male member that connects to the female port so that it may be easily removed from the cooking appliance when the cooking appliance is immersed in water and cleaned.

However, there are problems presently associated with the known temperature probes connected to the power supply. If a user trips over a power cord that connects the temperature probe to a power supply, a force is imparted on the power cord and on the cooking appliance. This force pulling at the cooking appliance may cause the cooking appliance to fall and/or tip over, thus releasing its scalding hot oil and contents on a floor or a user.

One attempt in the art to remedy this problem is U.S. Pat. No. 6,267,602 to Mendelson that has a magnetic assembly with a magnet and a ferrous member to secure a power cord assembly to a temperature probe. However, this arrangement is not satisfactory since heat emitted from the cooking appliance can lessen the magnetic properties of the magnet. Thus, the magnet will not appropriately secure the power supply assembly to the temperature probe during extended cooking.

Accordingly, there is a need for a reliable detachable power supply apparatus for use with a temperature probe. There is also a need for such a reliable and safe, detachable power supply apparatus that will engage the temperature probe to a power cord and also disengage if the power cord is pulled, without disturbing the appliance.

There is also a need for such a detachable power supply apparatus that eliminates one or more of the aforementioned drawbacks and deficiencies of the prior art.

SUMMARY OF THE INVENTION

It is an object of the present invention to provide a detachable power supply apparatus for an electric appliance where the detachable power supply apparatus can be removed or pulled without disturbing the electric appliance.

It is another object of the present invention to provide a detachable power supply apparatus that is safe and that will not tip over the electric appliance if pulled or removed from the electric appliance.

It is yet another object of the present invention to provide a detachable power supply apparatus that has a temperature control device and a power supply cord that selectively fastens to the temperature control device.

It is still another object of the present invention to provide a detachable power supply apparatus for an electrical appliance that provides power to the electrical appliance and has a temperature probe that can be removed from the electrical appliance for cleaning.

It is a further object of the present invention to provide a detachable power supply cord that is connected to a temperature probe that disengages upon application of a desired force but remains engaged at other undesired forces that are less than the desired force.

A detachable power supply apparatus for an appliance of the present invention achieves these and other objects and advantages of the present invention. The detachable power supply apparatus has a temperature control device for electrical connection to an appliance. The temperature control device has a first member extending outwardly from a first side thereof. The temperature control device also has a conductor on the first side, and a probe on a second side opposite the first side. The detachable power supply apparatus has a power supply cord with preferably a female electrical connector at a power supply first end. The female connector can be connected to the conductor. The female connector can be removably connected to a power supply to supply power to the female connector and the conductor. The power supply cord preferably has a clip member on the first end of the power supply. The clip member selectively fastens to the first member so that upon application of a force on the power supply cord, the first member disengages the clip member without disturbing the position of the appliance.

DETAILED DESCRIPTION OF THE INVENTION

Figure 1:
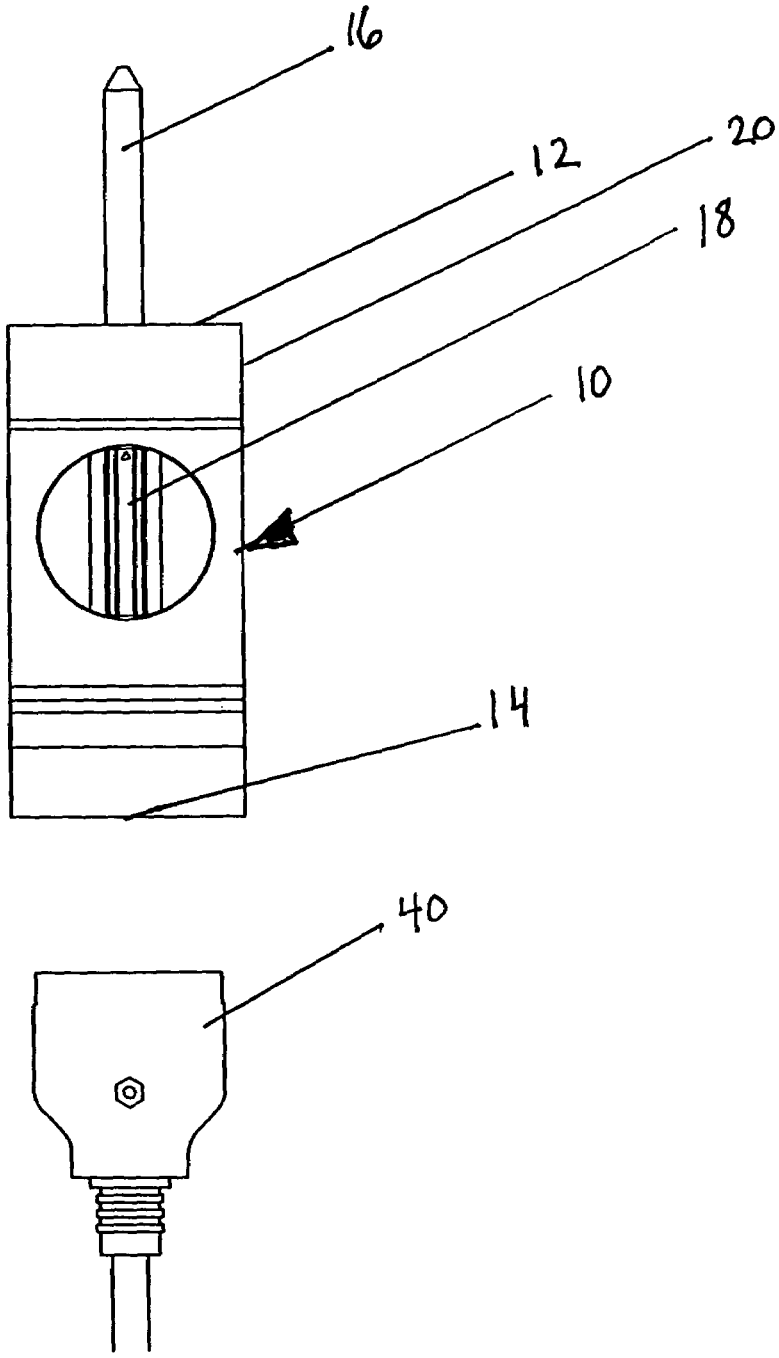
FIG. 1 is a top view of a preferred embodiment of a detachable power supply apparatus with a temperature control device and a power supply cord according to the present invention.

Referring to the figures and in particular FIG. 1, there is shown a temperature control device of the present invention generally represented by reference numeral 10. The temperature control device 10 is connectable to a cooking appliance (not shown).

The temperature control device 10 has a housing 20 with a first side 12 and a second side 14. The second side 14 is a substantially flat member that is substantially opposite the first side 12. The temperature control device 10 has a probe 16 on the first side 12. The probe 16 extends outwardly from the temperature control device 10 on the first side 12. The probe 16 preferably is generally elongated and cylindrical in shape. The probe 16 has a length that is suitable to insert the probe into the appliance such as a cooker, a popcorn maker, a griller, a broiler, deep fat fryer, or any other electrical cooking appliance known in the art.

Preferably, the probe 16 is made from a thermally conductive material such as a metal, steel, copper, or any other ferrous material known in the art. The probe 16 is preferably connected to a thermostat (not shown) positioned preferably, in the temperature control device 10. One skilled in the art should appreciate that the temperature control device 10 may have any thermostat known in the art, such as a mercury thermostat, a bimetallic thermostat or any other thermostat, that automatically responds to temperature changes for controlling the appliance. Preferably, the temperature control device 10 has a knob or control dial 18 for selectively setting the control temperature of the appliance.

Alternatively, the temperature control device 10 may have one or more buttons, switches, remote control devices, or any combinations thereof, or any other arrangement know in the art for selectively setting the control temperature of the appliance. In one non-limiting embodiment, the temperature control device 10 may control an acceptable temperature level of, for example, a cooking device such as the fryer or the broiler.

The housing 20 is preferably an orthogonal shaped member that is formed from a resilient and durable material such as a thermoplastic, a metal, a moldable material or any resilient and durable material known in the art. Preferably, the housing 20 forms an interior space to house a number of electrical components such as the thermostat and electrical contacts disposed therein.

Figure 2:
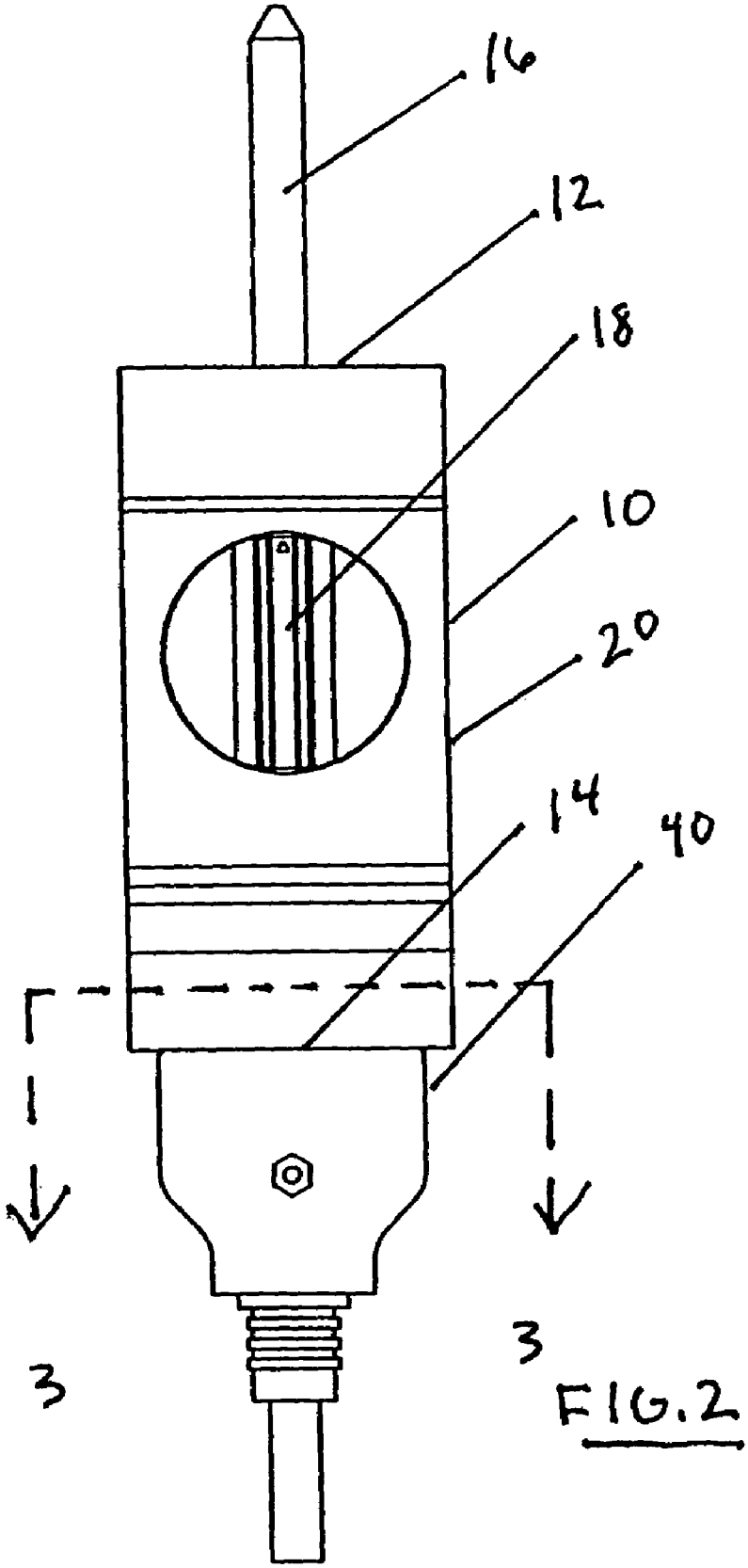
FIG. 2 is a top view of the temperature control device of FIG. 1 being in an engaged position relative to the power supply cord.

Referring to FIGS. 1 and 2, one longstanding problem in the art is a risk that a consumer may trip over a power supply cord 40. This tripping will subject the power supply cord 40 to a force, namely a tensile force. The tensile force will pull the temperature control device 10. In prior art temperature control devices, this tensile force may be relatively large enough to topple the appliance. This would release hot oil stored in the appliance thereby creating a hazardous condition. The power supply cord 40 and the temperature control device 10 of the present invention remedy this longstanding problem in the art.

Referring to FIG. 2, there is shown the power supply cord 40 in an engaged position relative to the temperature control device 10. The engaged position is defined as the position in which the power supply cord 40 is connected to the temperature control device 10 so that the temperature control device receives power from a power source (not shown) through the power supply cord. In one embodiment of the present invention, the power supply cord 40 may be connected to the temperature control device 10 on the second side 14. However, one skilled in the art should appreciate that the power supply cord 40 may be connected to the first side 12, the top of the housing 20, the bottom of the housing, or any other suitable location on the temperature control device, and is not limited to a connection to the second side 14 as shown in FIG. 2.

Referring to FIG. 1, upon a tensile force being applied to the power supply cord 40 as shown by reference arrow 22, the power supply cord will readily disengage from the temperature control device 10, without transferring force to the temperature control device. Thus, the appliance will not move or topple. Instead, the power cord 40 will merely pull opposite the second side 14, as shown, without disturbing the position of the temperature control device 10. In this manner, the appliance (not shown) will not topple over and, thus, will remain in a safe and operating condition.

Figure 3:
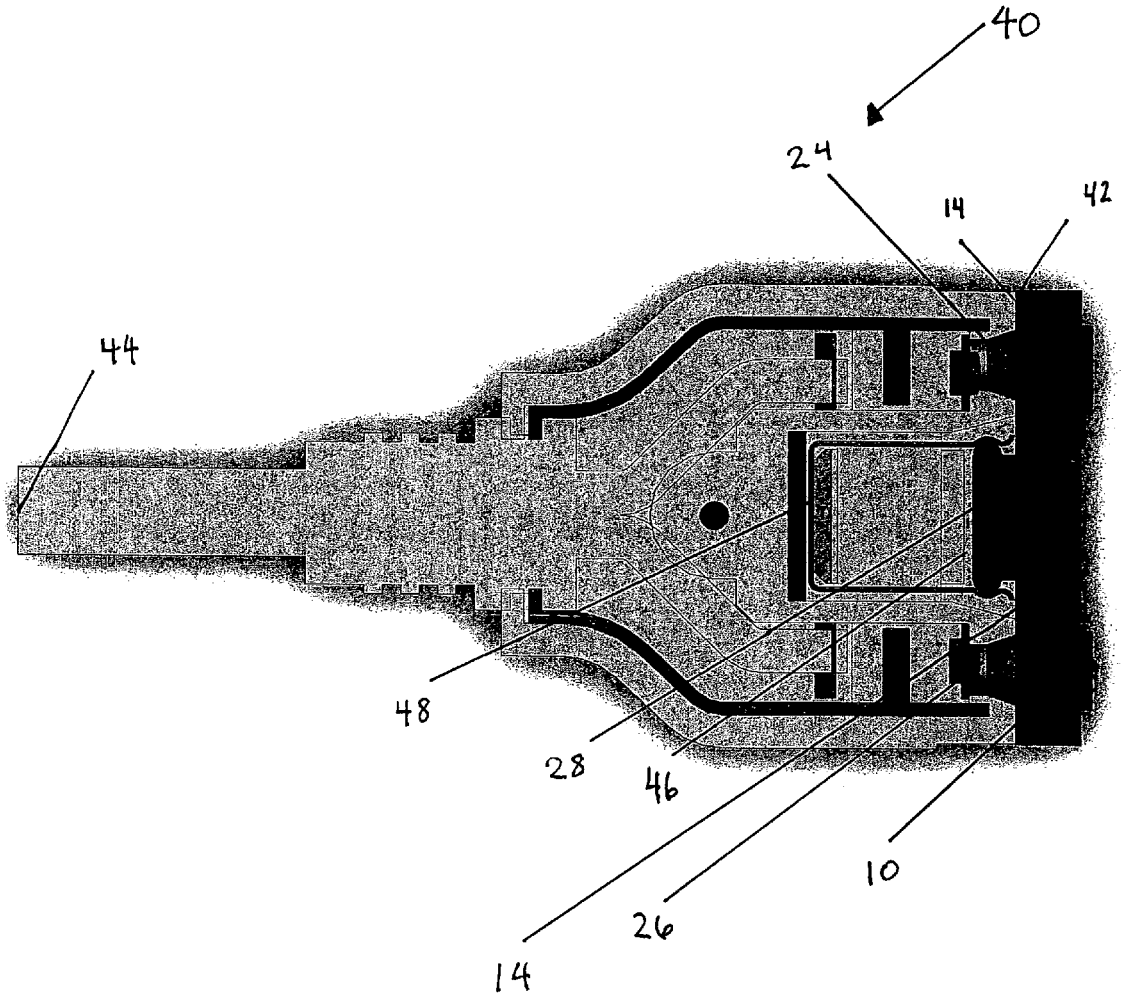
FIG. 3 is a cross sectional view of the temperature control device of FIG. 1 in an engaged position relative to the power supply cord of FIG. 2 taken along line 3—3 of FIG. 2.

Referring to FIG. 3, the temperature control device 10 preferably has a first conductor 24 and a second conductor 26. Preferably, both are on the second side 14 of the temperature control device. The first conductor 24 and the second conductor 26 preferably extend outwardly from the second side 14 of the temperature control device 10. Preferably, the first conductor 24 and the second conductor 26 are each made of copper, metal or any other suitable electrically conductive material. The first conductor 24 and the second conductor 26 are electrically connected to the probe 16 in the housing 20, and preferably supply power from the power source to the temperature control device 10.

Figure 4:
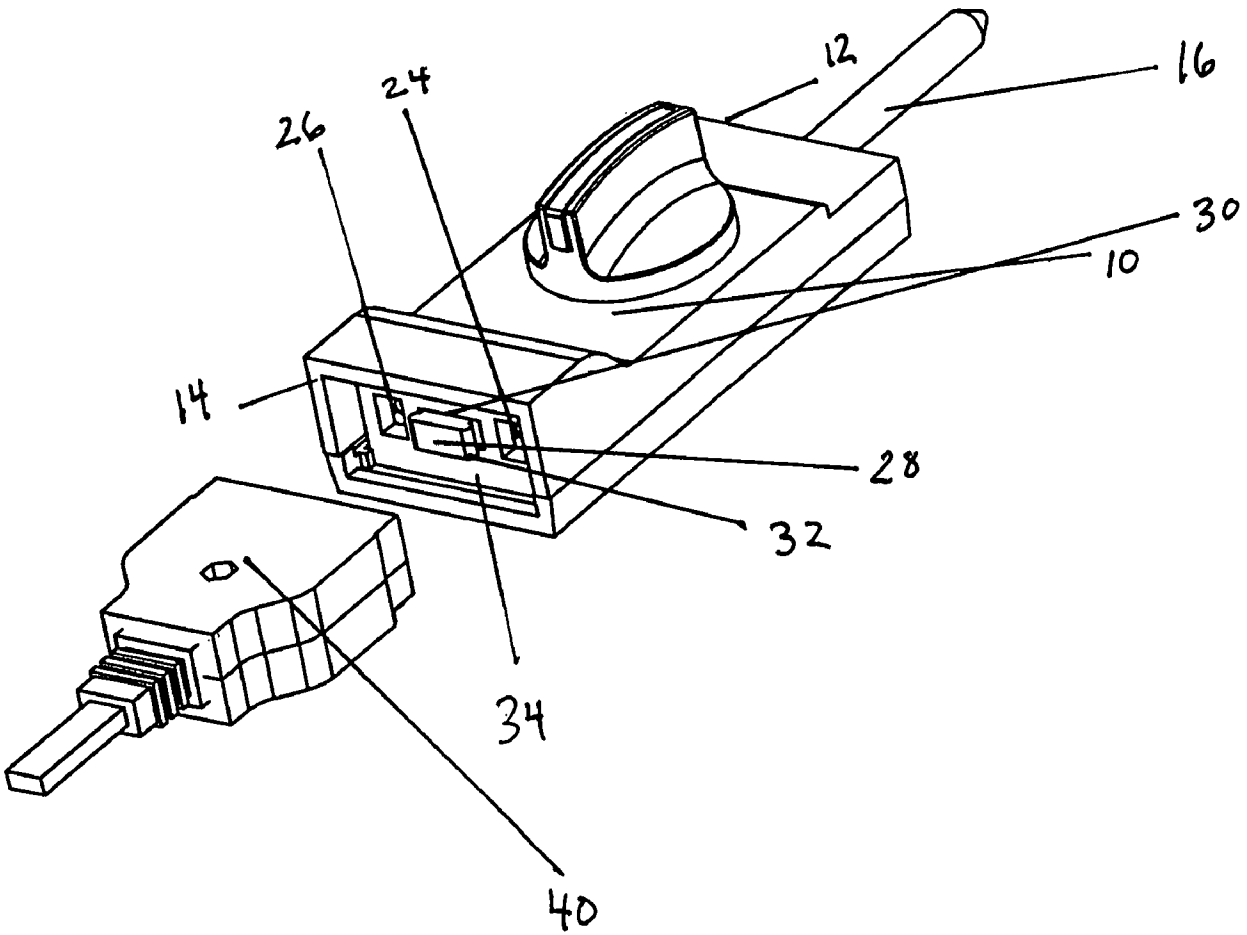
FIG. 4 is a first perspective view of the temperature control device being disengaged from the power supply cord of FIG. 1.

Referring to FIG. 4, the first member 28 is preferably a plug. The first member 28 has a first stem portion 30 and a bulbous second portion 32 connected to the first stem portion. Preferably, the bulbous second portion 32 has a diameter that is relatively larger than a diameter of the first stem portion 30 to engage one or more complementary structures on the power supply cord 10.

Preferably, the first member 28 has a substantially fungiform or bulbous shaped. Fungiform shaped is defined as being shaped like or vertically like a mushroom. The first member 28 preferably is in a notch 34 in the second side 14 of the temperature control device 10. Preferably, this notch 34 is generally orthogonally shaped. The notch 34 has a suitable size to correspond to the power supply cord 40 and to allow the power supply cord to fit therein. The notch 34 preferably is larger than the power supply cord 40 to allow the power supply cord access to the first member 28. One skilled in the art should appreciate that the notch 34 is not limited to this size and may have any size known in the art.

The first member 28 extends outwardly, and generally perpendicular, from the notch 34 in the second side 14 of the temperature control device 10. In one embodiment, the first member 28 is a resilient member. For example, the first member 28 can be a pin, a catch pin, or any other resilient bulbous member known in the art. Preferably, the first member 28 is made from both a thermally non-conductive and a resilient material.

One skilled in the art should appreciate that the first member 28 connects to another corresponding structure disposed on the power supply cord 40. Preferably, the first member 28 is between the first conductor 24 and the second conductor 26 on the second side 14 of the housing 20. However, one skilled in the art should appreciate that the first member 28 may be disposed anywhere on or in the second side 14, with the first conductor 24 and the second conductor 26 adjacent to the first member or, alternatively, in any other location on the second side 14.

Figure 5:
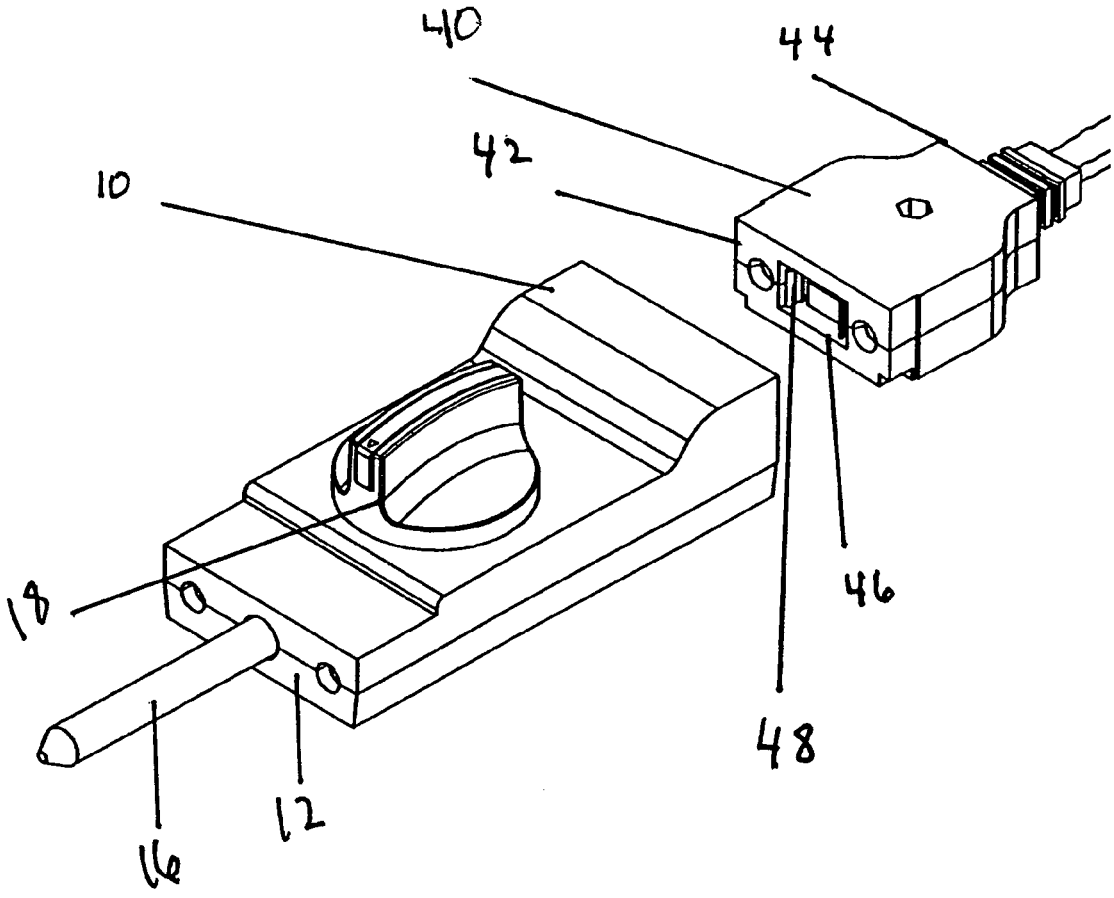
FIG. 5 is a second perspective view of the temperature control device being disengaged from the power supply cord with the second perspective view being rotated one hundred and eighty degrees relative to the first perspective view of FIG. 4.

Referring to FIG. 5, the power supply cord 40 has a first side 42 and a second side 44 opposite the first side. The first side 42 has a recess 46 disposed in the first side. The recess 46 is preferably an orthogonal shaped indentation. The recess 46 has a depth in the power supply cord 40 in a direction toward the second side 44. One skilled in the art should appreciate that although the second side 44 is shown as being closely adjacent to the first side 42 for illustration purposes, the second side may be a distance away from the first side depending upon a desired length of the power supply cord 40. One skilled in the art should appreciate that the power supply cord 40 may be two feet, four feet, six feet, ten feet or any other desired length depending upon the consumer's preferences and the availability of electrical outlets to connect the appliance to a power source.

Figure 6:
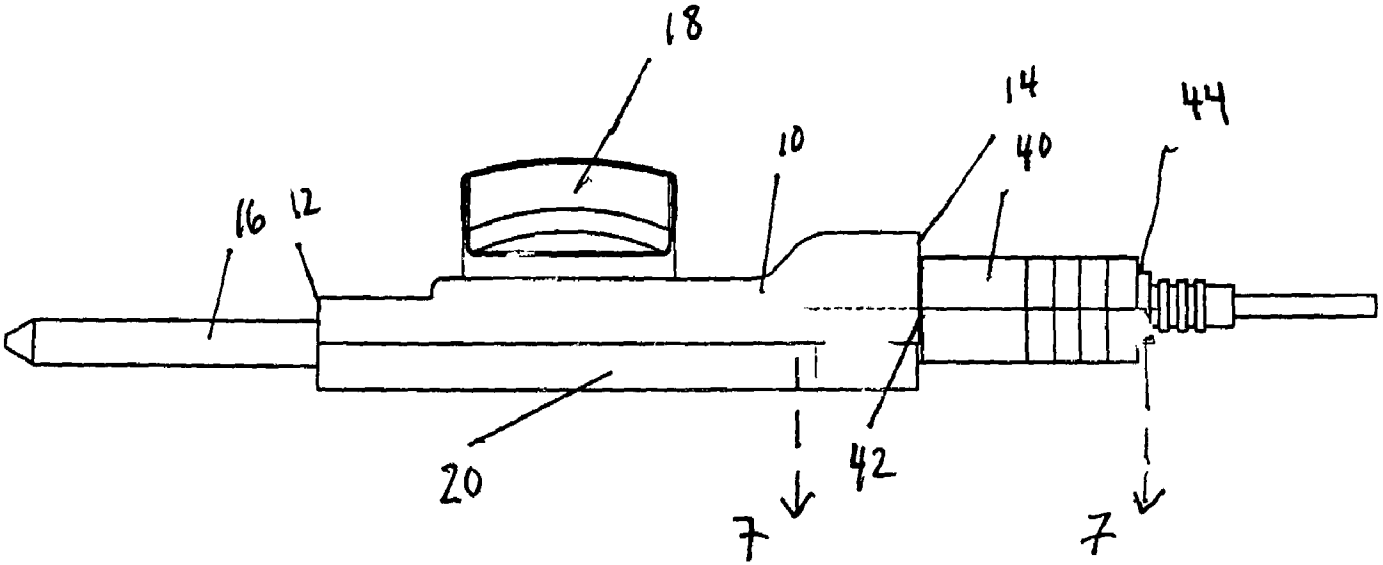
FIG. 6 is a side view of the temperature control device being engaged to the power supply cord.

Referring to the first side 42 of the power supply cord 40 at the recess 46, the power supply cord has a friction clip 48. The friction clip 48 is connected in the recess 46 of the power supply cord 40. Referring to FIG. 6, the power supply cord 40 transfers power to the temperature control device 10. Simultaneous with this transfer of power, the first member 28 of the temperature control device 10 selectively engages with the friction clip 48 and thus the first member is retained on the friction clip of the power supply cord 40.

Figure 7:
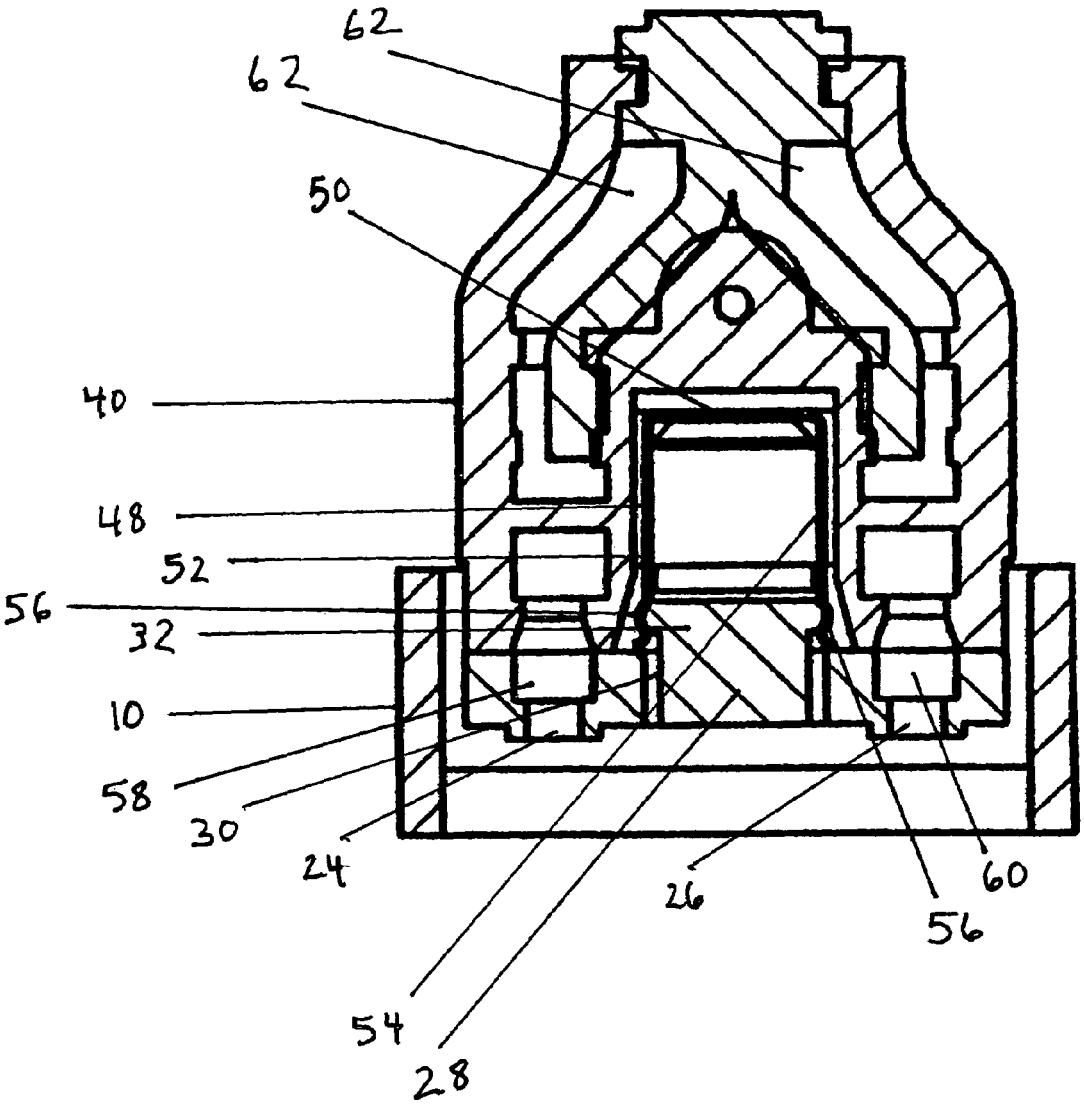
FIG. 7 is another enlarged cross sectional view of the temperature control device engaged to the power supply cord taken along line 7—7 of FIG. 6.

Referring to FIG. 7, the friction clip 48 is preferably substantially "U" shaped and has a base portion 50 with a first arm 52 and a second arm 54. Alternatively, the friction clip 48 may be any device known in the art for gripping or selectively gripping the bulbous second portion 32 of the first member 28. Preferably, the first arm 52 and the second arm 54 are a distance away from one another to allow the bulbous second portion 32 of the first member 28 access between the first arm 52 and the second arm 54.

Preferably, the distance is complementary in size to the diameter of the bulbous second portion 32 of the first member 28. Each of the first arm 52 and the second arm 54 preferably has a clipping portion 56 thereon. The clipping portion 56 is preferably an arcuate section that is formed on each of the first arm 52 and the second arm 54. The clipping portion 56 preferably has a curvature. The curvature has similar and complementary dimensions relative to the bulbous second portion 32 of the first member 28 of the temperature control device 10. In this manner, the bulbous second portion 32 of the first member 28 may be selectively gripped and retained on the friction clip 48. When the power supply cord 40 is pulled an amount by the tensile force, the first arm 52 and the second arm 54 of the friction clip 48 will move a predetermined amount in opposite directions relative to one another to release the first member 28. The first arm 52 of the friction clip 48 will move opposite the second arm 54, and the second arm will move opposite the first arm, and thus release the bulbous second portion 32 of the first member 28 without disturbing any position of the temperature control device 10 or any appliance connected to the temperature control device.

In this engaged position, the first member 28 is selectively fastened to the friction clip 48 as shown. Preferably, the friction clip 48 is formed from a preselected durable material to provide a disengagement tensile force index number 64.

Upon application of a first tensile force to the power supply cord 40 by, for example, pulling the power supply cord with the first tensile force less than the disengagement tensile force index number 64, the friction clip 48 will remain connected to the first member 28. Accordingly, this first tensile force is insufficient to disengage the power supply cord 40 from the temperature control device 10 and accordingly the power supply cord will remain connected to the temperature control device.

In a second instance upon an application of a second tensile force that is relatively larger than the first tensile force that exceeds the disengagement tensile force index number 64, the friction clip 48 will release and disengage the first member 28. This allows the power supply cord 40 to disengage from the temperature control device 10 allowing the temperature control device to remain connected to the appliance without substantially disturbing the position of the appliance. This will prevent the appliance from being overturned, increase the safety of the power supply cord 40 and thus reduces any risk of potentially harming the user.

The power supply cord 40 has a first female electrical connector 58 and a second female electrical connector 60. The first female electrical connector 58 and the second female electrical connector 60 are both preferably apertures in the recess 46 of the power supply cord 40. The first female electrical connector 58 and the second female electrical connector 60 allow access to an interior space of the power supply cord 40 and also provide electrical conductivity to power from the power source. The interior of the power supply cord 40 has a conductive material to transfer this power to the first female electrical connector 58 and the second female electrical connector 60. Preferably, this conductive material is a wire 62 operatively connected to the power supply.

Figure 8:
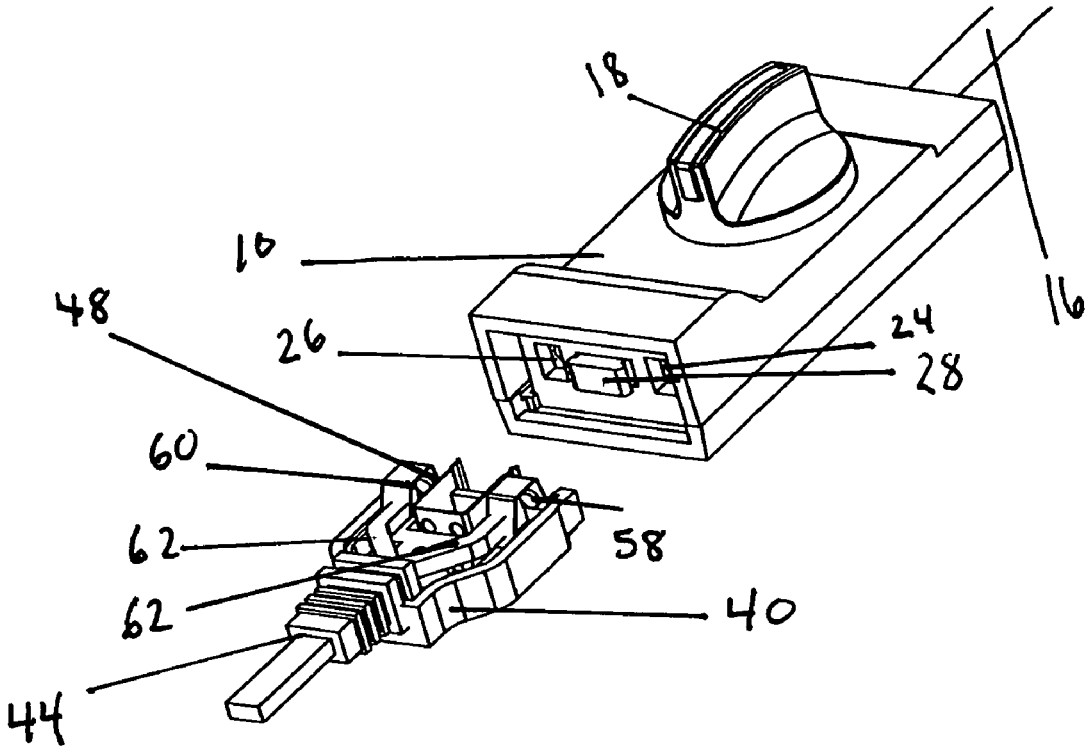
FIG. 8 is a perspective view of the power cord being disengaged and with a top of the power cord partially removed to shown an inner portion thereof.

Referring to FIG. 8, the wire 62 is preferably connected to a conventional commercial or residential wall outlet (not shown) on the second side 44 of the power supply cord 40 to provide power to the temperature control device 10. The first female electrical connector 58 and the second female electrical connector 60 are both preferably arranged complementary in position to the first conductor 24 and the second conductor 26 of the temperature control device 10. The first female electrical connector 58 and the second female electrical connector 60 both preferably receive the respective first conductor 24 and the second conductor 26 to energize the temperature control device 10 and the appliance connected to the temperature control device.

Although, the friction clip 48 is shown in FIG. 8 as a "U" shaped member, the friction clip may, in other embodiment, have other shapes. For example, the friction clip 48 may be "V" shaped, "Y" shaped, "U" shaped, "O" shaped or any other shape in the art.

Figure 9:
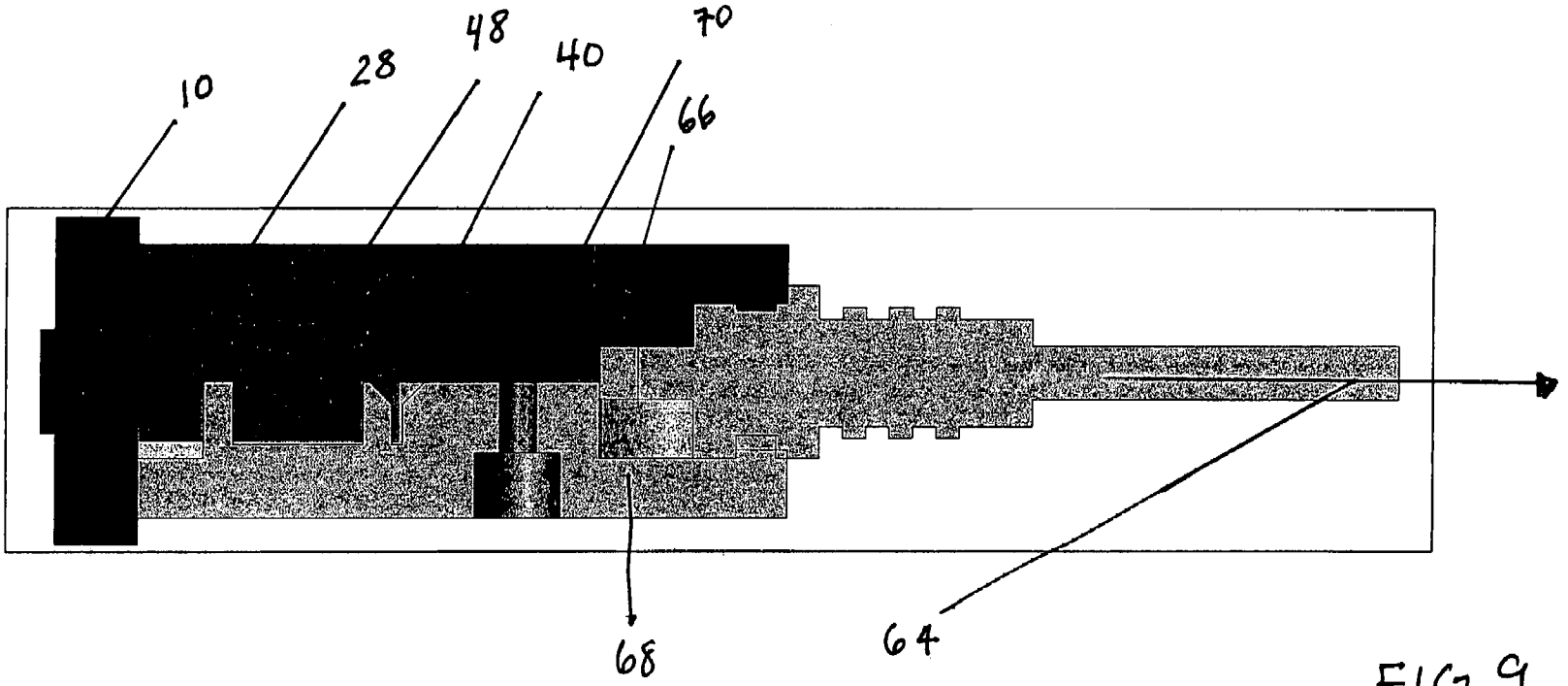
FIG. 9 is still another cross sectional side view of the power supply cord connected to the temperature control device.

Referring to FIG. 9, the first conductor 24 and the second conductor 26 of the temperature control device 10 of FIG. 3 are connected to the respective first female electrical connector 58 and the second female electrical connector 60 of the power supply cord 40 of FIG. 7. When the power supply cord 40 is connected to the temperature control device 10, power traverses through the power supply cord from the power supply, through the first female electrical connector 58 and the second female electrical connector 60 to the respective first conductor 24 and the second conductor 26 of the temperature control device. In this manner, the temperature control device 10 is energized and receives power.

The probe 16 is inserted into a suitable sized port of the appliance to regulate the operating temperature of the appliance by positioning of the control dial 18. An aspect of the present invention is that the power supply cord 40 can engage the temperature control device 10 so that if the power supply cord is subject to the tensile force by being pulled or by a user tripping over the power supply cord, the power supply cord will disengage from the temperature control device 10 without disturbing the appliance, let alone toppling the appliance that may have scalding liquid or oil therein.

One skilled in the art should appreciate that in an alternative embodiment of the present invention, the friction clip 48 may be disposed on the temperature control device 10 and contemporaneously the first member 28 may be on the power supply cord 40. In yet another alternative embodiment, the power supply cord 40 may have one, two, three or any number of friction clips, and the temperature control device 10 may have a complementary number of members to selectively fasten to the power supply cord 40.

With reference again to FIG. 9, one skilled in the art should also appreciate that the housing 20 of the power supply cord 40 may be assembled from a first housing member 66 and a second housing member 68. Preferably, the first housing member 66 and the second housing member 68 are both preferably orthogonal shaped members that are formed from a resilient and durable material such as a thermoplastic, a metal, a moldable material or any resilient and durable material known in the art. Preferably, the both the first housing member 66 and the second housing member 68 form an interior space to house a number of electrical components such as the thermostat and electrical contacts disposed therein. The first housing member 66 and the second housing member 68 are both preferably made from a durable, resilient and non-conductive material to maximize safety of any user holding or handling the power supply cord. Also, the first housing member 66 and the second housing member 68 are connected to one another by a mechanical fastener 70 such as a screw, a bolt, a lug, a nail and any combinations thereof.

Figure 10:
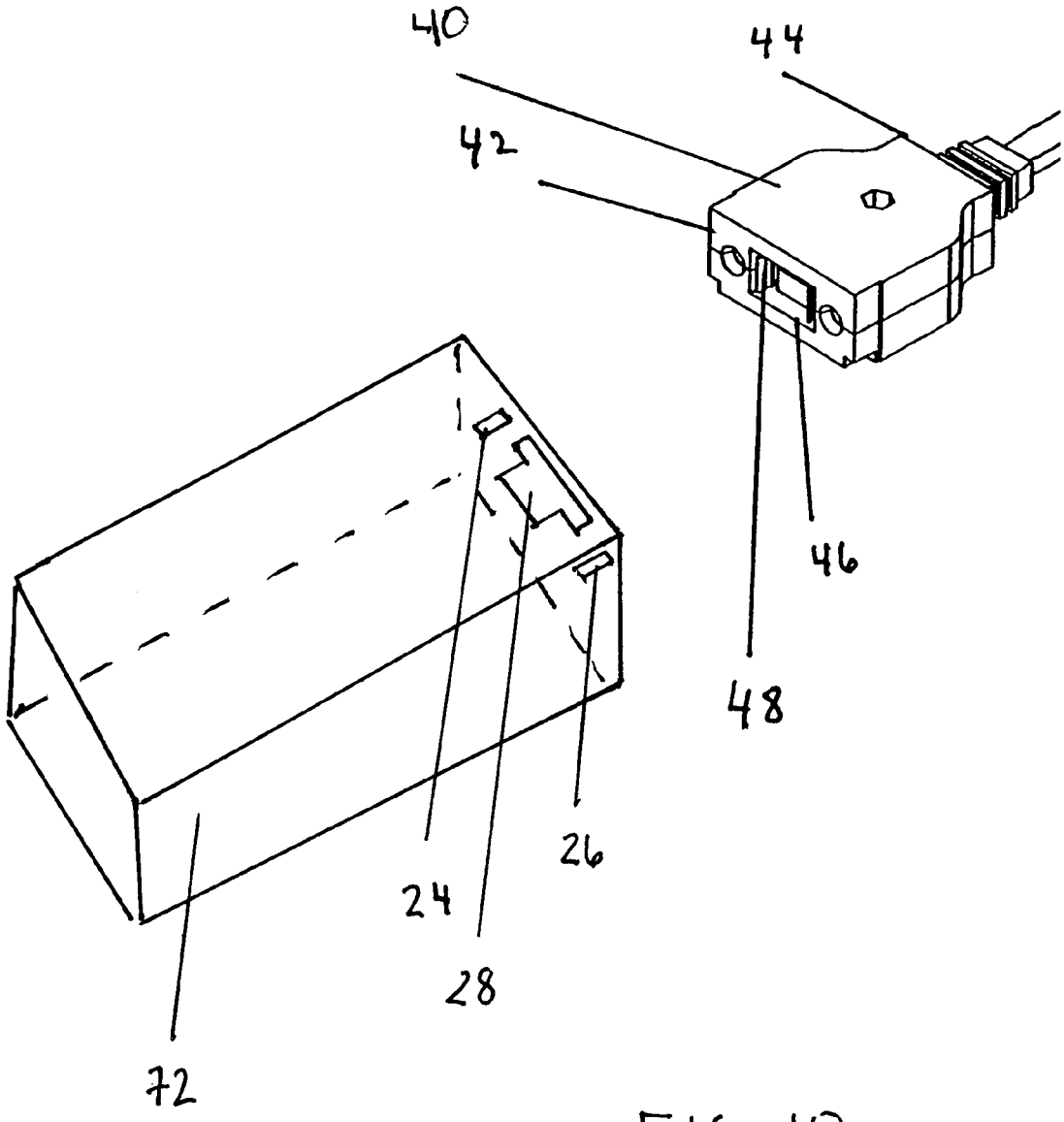
FIG. 10 is another embodiment the power supply cord of FIG. 1 connected to an electrical device.

Referring to FIG. 10, there is shown another preferred embodiment of the present invention with an electrical device 72 disengaged from the power supply cord 40. Preferably, the electrical device 72 in this embodiment may be any electrical appliance using an alternating or direct electric current known in the art and is not limited to any temperature control device 10 shown in FIGS. 1 through 9. Preferably, the electrical device 72 has the first conductor 24, the second conductor 26 and the first member 28. Preferably, the first member 28 of the electrical device 72 connects to another corresponding structure disposed on the power supply cord 40. Preferably, in this embodiment, the first member 28 connects to the friction clip 48 on the power supply cord 40. One skilled in the art should appreciate that the electrical device 72 may be a cooking appliance, a consumer appliance, an industrial appliance, a recording device, a video device, a computer device, a printer, a computer printer related device, an automotive related device or any other device using an electrical or a direct current known in the art.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A detachable power supply apparatus for an appliance comprising:

a temperature control device for electrical connection to the appliance, said temperature control device having a body with a first side and a second side being substantially opposite said first side, said temperature control device having a first member extending outwardly from said first side, said temperature control device having a conductor near said first side and a probe on said second side; and a power supply cord having a female electrical connector at a first end of a power supply, said female connector connecting to said conductor and being connectable to the power supply to supply power to said female connector and to said conductor, said power supply cord having a clip member on said first end of the power supply, wherein said clip member selectively fastens to said first member so that said first member disengages said clip member such that the appliance does not substantially move upon application of a force on said power supply cord.

2. The detachable power supply apparatus of claim 1, wherein said first member has a stem connected to a spherical portion.

3. The detachable power supply apparatus of claim 1, wherein said clip member is a friction clip that is substantially "U" shaped.

4. The detachable power supply apparatus of claim 1, wherein said first member is substantially fungiform shaped.

5. The detachable power supply apparatus of claim 4, wherein said first member is between a plurality of conductors on said first side.

6. The detachable power supply apparatus of claim 4, wherein said clip member is between said female electrical connector and a second female electrical connector on said power supply cord in a recess in said power supply cord.

7. The detachable power supply apparatus of claim 4, wherein said clip member has a shape selected from the group consisting of "V" shaped, "Y" shaped, "O" shaped, and any combinations thereof.

8. The detachable power supply apparatus of claim 4, wherein said first member and said clip member disengage relative to one another upon application of a predetermined force.

9. The detachable power supply apparatus of claim 1, wherein said probe selectively connects to a port of the appliance, said temperature control device having a thermostat electrically connected to said probe, said temperature control device controlling an operating temperature of the appliance.

10. The detachable power supply apparatus of claim 9, wherein said temperature control device has a control dial, said control dial controlling said operating temperature of the appliance.

11. A detachable power supply apparatus for an appliance comprising:

a temperature control device having a body with a first side and a second side substantially opposite said first side, said temperature control device being electrically connected to the appliance, said temperature control device having a probe and a conductor, said probe extending outwardly from said first side, said conductor being on said second side; and a power supply cord having a first cord side and a second cord side being substantially opposite said second cord side, said power supply cord having a second conductor at said second cord side to connect to a power supply, said power supply cord having a female connector at said first cord side for connecting to said first conductor, wherein said second side removably connects to said first cord side, wherein said second side has a male member and said first cord side has a female clip member, said male member being removably engageable in said female clip member.

12. The detachable power supply apparatus of claim 11, wherein said second side removably connects to said first cord side by a plug.

13. The detachable power supply apparatus of claim claim 11, wherein said male member is a plug, said plug having a first stem portion and a second bulbous member, said second bulbous member being connected to said first stem portion.

14. The detachable power supply apparatus of claim 11, wherein said female clip member is a substantially "U" shaped friction clip.

15. The detachable power supply apparatus of claim 13, wherein said female clip member is a friction clip, said friction clip having a size complementary to a size of said second bulbous member.

16. The detachable power supply apparatus of claim 11, wherein said conductor is engageable with said female connector so that said temperature control device receives power from the power supply.

17. A detachable power supply apparatus for an appliance comprising:

a first electrical component having a body, said first electrical component being electrically connected to the appliance by a first conductive member on a first side; and a second component having a body with a second side, wherein said first electrical component has a member at said first side, and wherein said second component has a friction clip at said second side, said second side being complementary to said first side so that said friction clip releasably engages said member and releases said member upon an application of a force upon either said first component and said second component such that the appliance does not substantially move.

18. The detachable power supply of claim 17, wherein power traverses from said power source to said first electrical component when said friction clip releasably engages said member, and wherein power does not traverse from said power source to said first electrical component when said friction clip releasably disengages said member.

19. The detachable power supply of claim 17, wherein said friction clip has a base portion connected to a first arm and connected to a second arm, said first arm having a first curved portion, said second arm having a second curved portion, said member having a stem and a bulbous portion connected to said stem, said first curved portion and said second curved portion releasably engaging said bulbous portion.

20. A power supply apparatus for an electrical appliance comprising:

a housing with a first side and a second side, said first side connected to a power supply, wherein said housing has a friction clip at said second side, wherein said friction clip releasably engages the electrical appliance, wherein said friction clip selectively releases the electrical appliance upon an application of a force such that the location of the appliance does not substantially move, and wherein said friction clip has a base portion connected to a first arm and connected to a second arm, said first arm having a first curved portion, said second arm having a second curved portion, and wherein said first curved portion and said second curved portion releasably engages the electrical appliance.

21. The power supply apparatus of claim 20, wherein said friction clip is substantially "U" shaped and releasably engages a bulbous member on the electrical appliance.

22. The power supply apparatus of claim 20, wherein said friction clip has a shape selected from the group consisting of "V" shaped, "Y" shaped, "O" shaped, and any combinations thereof.

* * * * *